United States Patent [19]

Josemans et al.

[11] 4,101,749

[45] Jul. 18, 1978

[54] ELECTRICAL ATTACHMENT OF INDICATING LAMP TO TERMINALS IN ELECTRIC SWITCHES

[75] Inventors: Leonardus J. Josemans, Smithfield, N.C.; John A. Swessel, Jr., Milwaukee, Wis.

[73] Assignee: Cutler-Hammer, Inc., Milwaukee, Wis.

[21] Appl. No.: 750,969

[22] Filed: Dec. 15, 1976

[51] Int. Cl.[2] ..... H01H 9/00

[52] U.S. Cl. ..... 200/317; 200/310; 200/315

[58] Field of Search ..... 200/308, 310, 313, 315, 200/317

[56] References Cited

U.S. PATENT DOCUMENTS

| | | | |
|---|---|---|---|
| 3,308,260 | 3/1967 | Krieger et al. | 200/317 X |
| 3,409,751 | 11/1968 | Krieger | 200/315 |
| 3,622,949 | 11/1971 | Sorenson | 339/147 C |
| 3,634,601 | 1/1972 | Pauza | 174/68.5 |
| 3,701,870 | 10/1972 | Sorenson | 200/317 X |

*Primary Examiner*—William Price
*Assistant Examiner*—Steven M. Pollard
*Attorney, Agent, or Firm*—Hugh R. Rather; William A. Autio; Michael E. Taken

[57] ABSTRACT

An improved method and means for making electrical connections for an internal indicating lamp within a small switch. The conducting leads of the lamp and/or a voltage dropping resistor are connected to and held in good electrical engagement with stationary terminals of the switch as an incident to the terminals being seated in place of the switch housing and secured thereto thereby eliminating the need for special connectors or soldering or welding of the leads to the terminals.

5 Claims, 3 Drawing Figures

ELECTRICAL ATTACHMENT OF INDICATING LAMP TO TERMINALS IN ELECTRIC SWITCHES

BACKGROUND OF THE INVENTION

Small electric switches with internally mounted indicating lamps are used in certain appliances to provide a visual indication at a distance. In the assembly of such switches the leads to the indicating lamps are usually soldered, welded or provided with a special connector means to stationary current carrying terminals within the switch housing. Such electrical attachment of the lamp leads to the switch terminals requires extra steps and materials which add to the cost of manufacture.

OBJECTS OF THE INVENTION

It is the primary object of the present invention to provide an improved electrical attachment means for indicating lamps mounted interiorally within switches which eliminates the need for soldering, welding or use of special connectors; and a more specific object of the invention is to provide for attaching of the electrical leads to indicating lamps and/or any associated voltage dropping resistors as an incident to the mounting of the stationary terminals to which they are to be electrically connected in the switch housing and the final securement of such terminals in the housing.

Other objects and advantages of the invention will hereinafter appear.

DESCRIPTION OF THE PREFERRED EMBODIMENT

Figure 1:
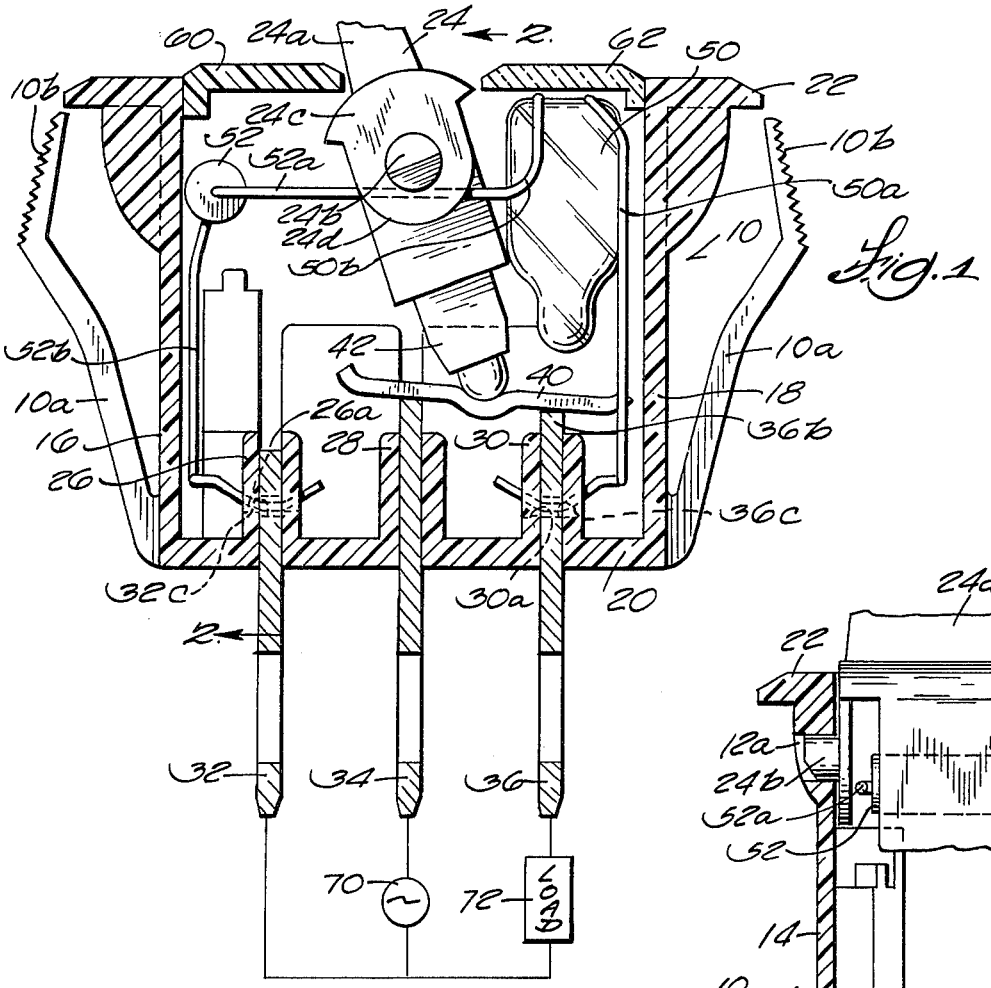
FIG. 1 is a view in longitudinal cross section of a switch constructed in accordance with the invention.

As shown in the drawings the switch of the present invention comprises a molded housing 10 which has spaced apart side walls 12 and 14, end walls 16 and 18, and a bottom wall 20. An integral beveled flange 22 extends outwardly from the upper ends of the side and end walls of the housing.

Housing 10 is provided with a pair of integral, spaced apart, and upwardly and outwardly extending arms **10*a* at each end thereof. These arms are proportioned so that they can be flexed. Adjacent their ends along their outer surface the arms 10*a* are provided with a series of closely spaced notches or serrations 10*b*. When the switch is inserted into an appropriately sized rectangular opening in a panel the arms flex inwardly, and then snap outwardly to engage along their serrated portions with the inner surface of the panel where the flange 22** engages with the outer surface thereof. Such switch mounting and retaining arms are well known and do not form part of the present invention.

Figure 2:
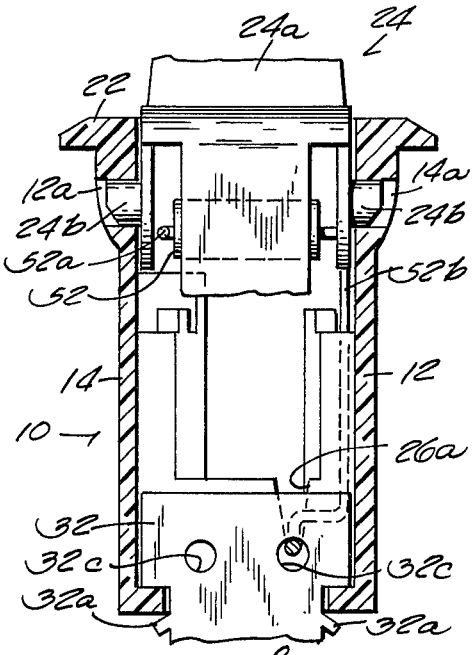
FIG. 2 is a view in transverse cross section taken along the line 1-1 of FIG. 2.

A lever operator 24 formed of a suitable insulating material has a handle portion **24*a* (fragmentarily shown) which extends outwardly above the surface of the flange 22 as shown in FIGS. 1 and 2. Operator 24 is pivotally supported in the side walls of housing 10 by integrally formed trunnion portions 24*b* which fit into aligned apertures 12*a* and 14*a* formed in the side walls 12 and 14. Operator 24 has an integral semicylindrical portion 24*c* at the base of the handle portion 24*a* and an integral cylindrical boss portion 24*d* which extends downwardly into the interior cavity of the housing 10**.

Housing 10 has three integral, spaced apart boss portions 26, 28 and 30, which extend upwardly from the inside surface of bottom wall 20. Each of these portions has a rectangular aperture extending from the inside cavity ends thereof to the outer surface of the wall 20. Boss portions 26 and 30 are alike and adjacent the side walls 12 and 14 respectively are provided with V-shaped notches **26*a* and 30*a* that extend across the side walls of such portions as best shown in FIG. 2. The purpose of the notches 26*a* and 30*a* will hereinafter be explained. The boss portion 28 is similar to the portions 26 and 30**, but lacks a notch as provided in the other two boss portions.

Electrical conducting stationary contact-terminal members 32, 34 and 36 are seated in housing 10 in the apertures in each of the boss portions 26, 28 and 30 respectively. These members are suitably staked over against the outer surface of wall 20 as shown for terminal 36 at **32*a* in FIG. 2 to prevent movement either inwardly or outwardly of the housing. Terminal 32 at its upper end extends to a point below the upper end of its associated boss portion 26. Terminal 34 at its upper end extends above the end of its associated boss portion 28, and its sides terminate spaced apart from the inner surfaces of the side walls of the housing 10. The upper end of terminal 36 extends to a point somewhat below the upper end of center terminal 34 as depicted in FIG. 1. The upper end of terminal 36** is preferably slightly convexly laterally curved.

A movable contactor 40 of the form shown in FIG. 1 and made of a good electrical conducting metal is movable within housing 10 to effect "ON" position electrical bridging contact between the center terminal 34 and either of the terminals 36. Contactor 40 is so moved by an operating member 42 which is resiliently mounted in a recess (not shown) in the portion **24*d* of lever 24. The details of the contact 40, and operating member 42** form no part of the present invention, but the details thereof can be more clearly understood by reference to our copending Patent Application, Ser. No. 730,367, filed Oct. 7, 1976.

Figure 3:
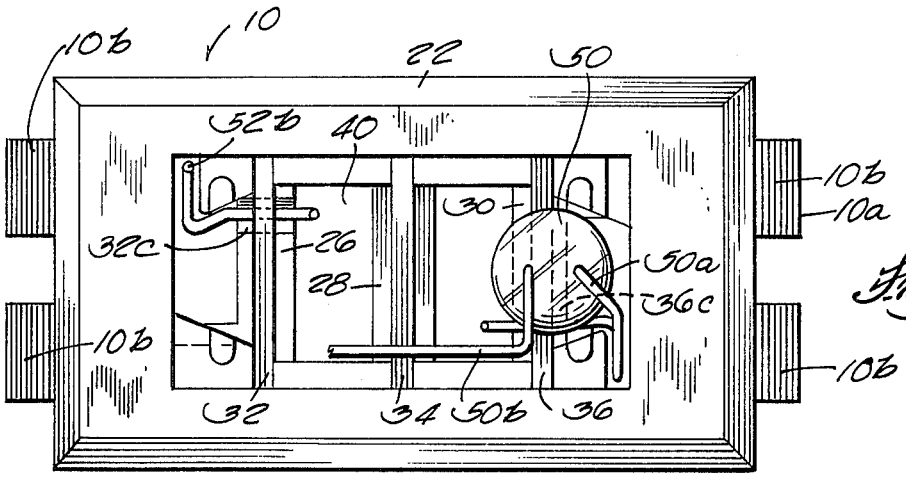
FIG. 3 is a top view of the switch with certain parts removed.

The switch of the present invention incorporates an indicating lamp 50 of the low voltage, integrally formed lead type. The lever **50*a* is suitably bent and formed to extend downwardly, then inwardly, and then longitudinally within the housing cavity as best shown in FIGS. 1 and 3. The lamp lead 50*b* extends part way toward the wall 14, then longitudinally, toward the wall 16 where it is joined in series with the lead 52*a* a voltage dropping resistor 52. The other lead 52*b* of resistor 52 extends downwardly along the surface of wall 12 and then longitudinally toward the center of the housing cavity. It will be apparent that the lamp 50 is situated and the aforementioned lamp and resistor leads are placed to prevent electrical contact with the terminals 34 and 36 and contactor 40**, and out-of-the-way of any moving parts within the housing cavity.

As best shown in FIGS. 1 and 2 the portions of the lamp lead **50*a* and resistor lead 52*a* are secured in good electrical conducting contact with the terminals 32 and 36 respectively. It is a feature of the present invention that such securement of these lamp and resistor leads is accomplished as an incident to insertion of the terminal members 32 and 36** into the opening in their associated boss as will now be fully explained.

As shown in FIG. 2 the terminals 32 and 36 are each provided with spaced apart aligned openings 32*c* and 36*c*. In assembling the terminals 32 and 36 to the housing 10 the lower ends thereof are first inserted into the inner most end of the openings in their associated boss portions 26 and 30. The terminals are then pushed downwardly until the lower ends of their openings 32*c* and 36*c* lie just above the inner ends of the boss portions 26 and 30. The lamp lead 50*a* and resistor lead 52*b* are then inserted through the openings 36*c* and 32*c* which align respectively with the notches 30*a* and 26*a* in their boss portions and extended laterally across their respective associated boss portions.

Terminals 32 and 36 are then pushed inwardly to their seated positions depicted in FIGS. 1 and 2, thereby trapping the leads 50*a* and 52*b* between the bottom of the notches 30*a* and 26*a* and the upper ends of the openings 36*c* and 32*c* in terminals 36 and 32. The aforementioned staking of terminals 36 and 32 in place insures that the leads 50*a* and 52*b* are held in good electrical contact with those terminals.

Snap-in inserts 60 and 62 formed of a molded semi-elastic insulating material are emplaced on opposite sides of the lever 24. These inserts partially overlie the intermediate cylindrical portion 24*c* of lever 24 to provide substantial closure for the upper side of the switch. Insert 62 which overlies the lamp 50 is preferably translucent, and may be appropriately colored to provide a corresponding colored light indication when contactor 40 is in its "ON" operating position.

As schematically depicted in FIG. 1 the indicating lamp will function properly when terminal 34 is connected to one side of an electrical supply source 70, terminal 32 is connected to the other side of that source and terminal 36 is connected in series with a load 72 to the last mentioned side of such source. It will be apparent that with the switch thus connected that lamp 50 and its associated series resistor 52 will be connected in parallel with the load 72 across the source whenever the switch in its operating position shown in FIG. 1.

When lever is pivotally operated in the clockwise direction viewed in FIG. 1, contactor 40 will be slidably and pivotally moved out of engagement with the end of terminal 36 to a position bridging the upper end of contact 34 and the upper end of the boss portion 26. As the upper end of terminal lies below the upper end of boss portion 26 circuit is thus not completed and lamp is then extinguished to indicate that the switch is in its "OFF" position.

As will be understood the aforedescribed improved method and means for effecting electrical connection of an internally mounted switch indicating lamp to current carrying members within the switch can be used with a variety of switch arrangements and is not limited to use with the particular embodiment herein disclosed.

We claim:

1. In an electric switch, in combination:

(a) a switch housing, (b) at least two spaced apart inwardly extending boss portions within said housing, each thereof having an aperture extending therethrough to an outer surface of the housing and a transversally extending notch formed at its inner end, (c) terminal members secured in place within the apertures in said boss portions and extending outwardly of said housing, each of said terminals being provided with a transverse aperture which is partially aligned with the bottom end of said notch in its associated boss portion, and (d) an electric indicating lamp mounted in said housing and having lead means extending through said notches in said boss portions and anchored in good electrical conducting relation with said terminal members between the bottom ends of said notches and the margins of the transverse terminal apertures.

2. The combination according to claim 1 wherein said notches in said boss portions are generally V-shaped.

3. The combination according to claim 1 wherein said lead means includes a voltage dropping resistor connected in series with said lamp.

4. The combination according to claim 1 wherein said terminals are flat and of generally rectangular cross section, wherein the apertures extending through said boss portions are complemental in form to the cross section of said terminals, and wherein the transverse apertures in said terminals are circular.

5. The combination according to claim 1 wherein a third terminal positioned between said first mentioned terminal is provided, wherein one of the first mentioned terminals extends beyond the inner end of its associated boss portion and the other thereof terminals below the inner end of its associated boss portion, and wherein a movable contactor is provided which in one operating position bridges said third and said one of said first mentioned terminals to complete circuit through said lamp.

* * * * *